US005605471A

United States Patent [19]

Plyler

[11] Patent Number: 5,605,471

[45] Date of Patent: Feb. 25, 1997

[54] ELECTRICAL CONNECTOR ASSEMBLY EMPLOYING A CONNECTOR POSITION ASSURANCE DEVICE

[75] Inventor: Robert G. Plyler, Vienna, Ohio

[73] Assignee: United Technologies Automotive, Inc., Dearborn, Mich.

[21] Appl. No.: 382,079

[22] Filed: Feb. 1, 1995

[51] Int. Cl.[6] ..... H01R 3/00

[52] U.S. Cl. ..... 439/489; 439/352

[58] Field of Search ..... 439/350, 351, 439/352, 353, 354, 355, 357, 358, 489, 488

[56] References Cited

U.S. PATENT DOCUMENTS

| | | | |
|---|---|---|---|
| 3,482,207 | 12/1969 | Cairns | 439/851 |
| 3,487,355 | 12/1969 | Cairns | 439/686 |
| 3,601,760 | 8/1971 | Cairns | 439/595 |
| 3,937,545 | 2/1976 | Cairns et al. | 439/272 |
| 4,238,140 | 12/1980 | Cairns et al. | 439/595 |
| 4,273,403 | 6/1981 | Cairns | 439/345 |
| 4,531,808 | 7/1985 | Cairns et al. | 439/830 |
| 4,634,204 | 1/1987 | Detter et al. | 439/352 |
| 4,717,359 | 1/1988 | Rahrig et al. | 439/595 |
| 5,120,255 | 6/1992 | Kouda et al. | 439/489 |
| 5,183,410 | 2/1993 | Inaba et al. | 439/489 |
| 5,219,300 | 6/1993 | Yagi et al. | 439/352 |
| 5,350,311 | 9/1994 | Roy et al. | 439/273 |
| 5,370,550 | 12/1994 | Alwine et al. | 439/352 |

OTHER PUBLICATIONS

1973 Car Shop Manual, Vol. III Electrical, Ford Marketing Corporation, pp. 32–40–02 –32–40–03, 33–70–03 –33–70–08, 34–01–01 –34–01–13, (Sep. 1972).

*Primary Examiner*—Hien Vu

*Attorney, Agent, or Firm*—Harness, Dickey & Pierce, P.L.C.

[57] ABSTRACT

An electrical connector assembly employing a connector position assurance device to aid in the retention of and signal full insertion of a pair of mating electrical connectors.

28 Claims, 2 Drawing Sheets

ELECTRICAL CONNECTOR ASSEMBLY EMPLOYING A CONNECTOR POSITION ASSURANCE DEVICE

BACKGROUND OF THE INVENTION

This invention relates generally to electrical connectors for automotive vehicles and specifically to an electrical connector assembly employing a connector position assurance device.

Recently, the demand for electrical features within automotive vehicles has greatly expanded. Such electrical features include motorized mirrors, motorized windows, motorized seat adjusters, motorized trunk lid pull down latches, navigational CRT displays, compact disc players and the like. This increase in electrical devices has necessitated more wire harness branches and the related electrical connectors.

Most traditional electrical connectors employ a stationary locking tab or rib on one mating half while the other mating half has a flexible arm with a locking or receiving slot. The arm flexes over the tab upon mating of the two connector halves and then the tab snaps into the slot thereby locking the connector halves together. Examples of such locking structures can be found within the following U.S. Pat. Nos.: 5,350,311 entitled "Seal for an Automotive Electrical Connector Assembly" which issued to Roy et al. on Sep. 27, 1994; U.S. Pat. No. 4,273,403 entitled "Locking Structure For Electrical Connectors" which issued to Cairns on Jun. 16, 1981; U.S. Pat. No. 4,238,140 entitled "Terminal Block with Electrical Connection Means with Connector Location Wall and Locking Finger" which issued to Cairns et al. on Dec. 9, 1980; U.S. Pat. No. 3,937,545 entitled "Waterproof Electrical Connector" which issued to Cairns et al. on Feb. 10, 1976; and, U.S. Pat. No. 3,601,760 entitled "Electrical Connector" which issued to Cairns on Aug. 24, 1971. The disclosures of the aforementioned patents are incorporated by reference herewithin. A problem often encountered with these conventional locking constructions is that the connectors may not be fully inserted together. In other words, male and female electrical terminals contained within each connector will not provide complete and reliable electrical continuity therebetween. This situation commonly leads to intermittent electrical failures which are extremely annoying to customers and often difficult to trace during service.

In response to the incomplete mating problem, a variety of locking detection devices have been employed. One such construction consists of a pair of mating electrical connectors each having an upstanding tab or rib with a transversely oriented passageway therethrough. When these connectors are completely inserted together, the passageways within the tabs will align such that an operator can then insert a plastic pin therethrough. This pin is often made from a bright colored polymeric material for visual confirmation. In some cases an end of the pin has a barb thereon for retention when inserted through the passageways. In another construction, a pin-like member is slidably mounted in a transverse orientation for engagement with an aperture of the opposite mating connector when fully aligned. This transversely sliding pin hangs beyond the transverse edge of the electrical connector prior to complete installation. Both of these traditional constructions have proven problematic during assembly along a quickly moving vehicle assembly line. Furthermore, they are often difficult to align and package in the tight spaces such electrical connectors are often employed.

Another locking confirming device construction is disclosed within U.S. Pat. No. 5,120,255 entitled "Complete Locking Confirming Device For Confirming the Complete Locking of an Electric Connector" which issued to Kouda et al. on Jun. 9, 1992, the disclosure of which is incorporated by reference herewithin. This patent shows a tri-forcated locking member (FIGS. 16 and 17) which is wedged between a flexible locking arm and a connector housing. This patent further discloses a lock detecting slider defined by a finger, a nose having a lower taper, a flat perpendicular body and a sliding plate. The upper surface of the finger is uniformly flat with the exception of a single projection and a set of serrated marks. It also appears possible to upwardly deflect a latching projection to disengage a locking projection even when the locking detecting slider is fully inserted.

SUMMARY OF THE INVENTION

In accordance with the present invention, the preferred embodiment of an electrical connector assembly employs a connector position assurance device to detect and interlockably secure complete mating of a pair of electrical connectors. In one aspect of the present invention, a connector position assurance device has a fin which secures the device to the corresponding electrical connector prior to complete installation. In another aspect of the present invention, a body of a connector position assurance device inhibits flexing of a locking arm toward an unlocking position upon full insertion of a connector position assurance device. In a further aspect of the present invention, a connector position assurance device prevents inadvertent disengagement of the locking features of the corresponding electrical connectors when the device is fully inserted. In yet another aspect of the present invention, a thinned section of a connector position assurance device encourages flexure thereat during mating of the electrical connectors. The present invention also provides a method of employing a connector position assurance device during mating of electrical connectors.

The electrical connector assembly of the present invention is advantageous over conventional constructions in a variety of manners. For example, the present invention connector position assurance device can be securely retained to the corresponding electrical connector prior to mating with the opposite electrical connector. Furthermore, the present invention connector position assurance device is easily packaged and inserted. Additionally, the present invention is advantageous over traditional devices in that movement of the connector position assurance device toward the fully installed position also serves to encourage mating engagement of the interlocking arms. The present invention electrical connector assembly also prevents inadvertent disassembly and disengagement of the interlocking arms when the connector position assurance device is fully inserted. Additional advantages and features of the present invention will become apparent from the following description and appended claims, taken in conjunction with the accompanying drawings.

DETAILED DESCRIPTION OF THE PREFERRED EMBODIMENT

Figure 1:
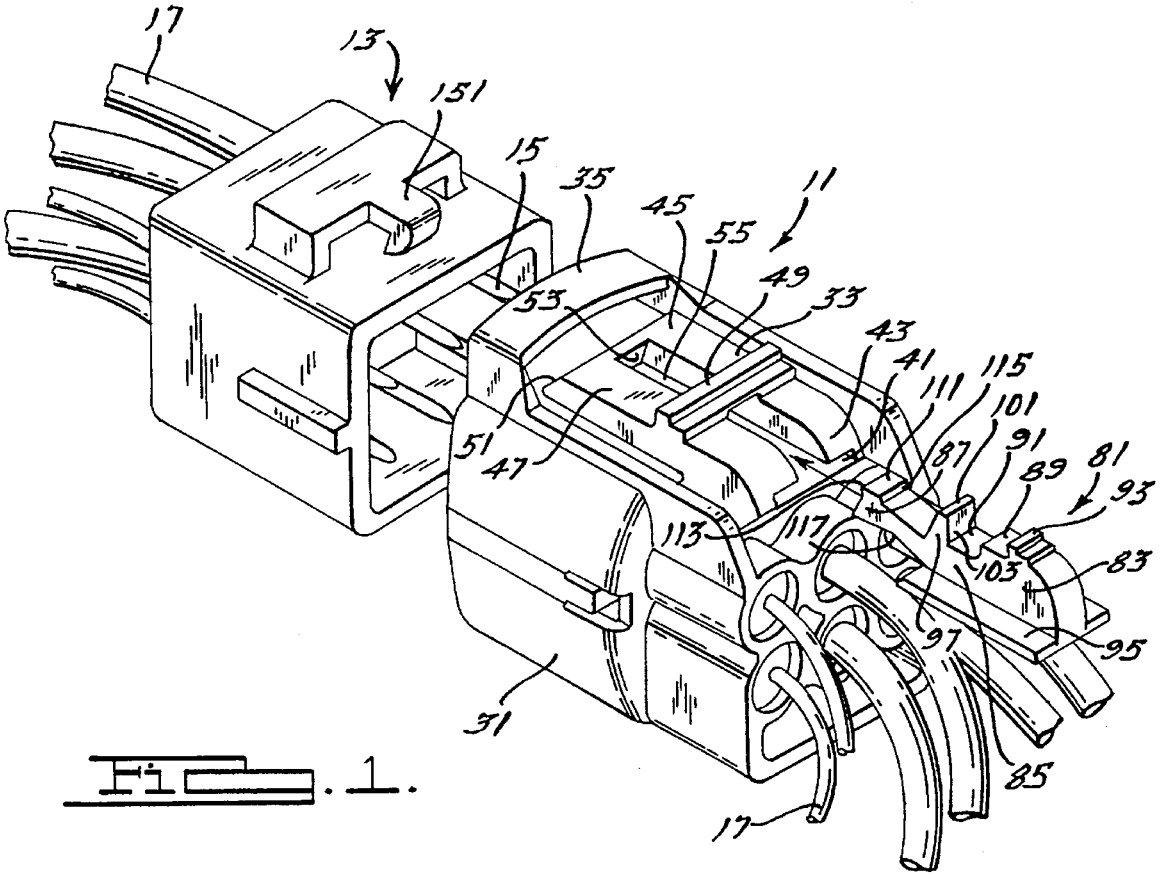
FIG. 1 is an exploded perspective view of the preferred embodiment of an electrical connector assembly of the present invention.
Figure 2:
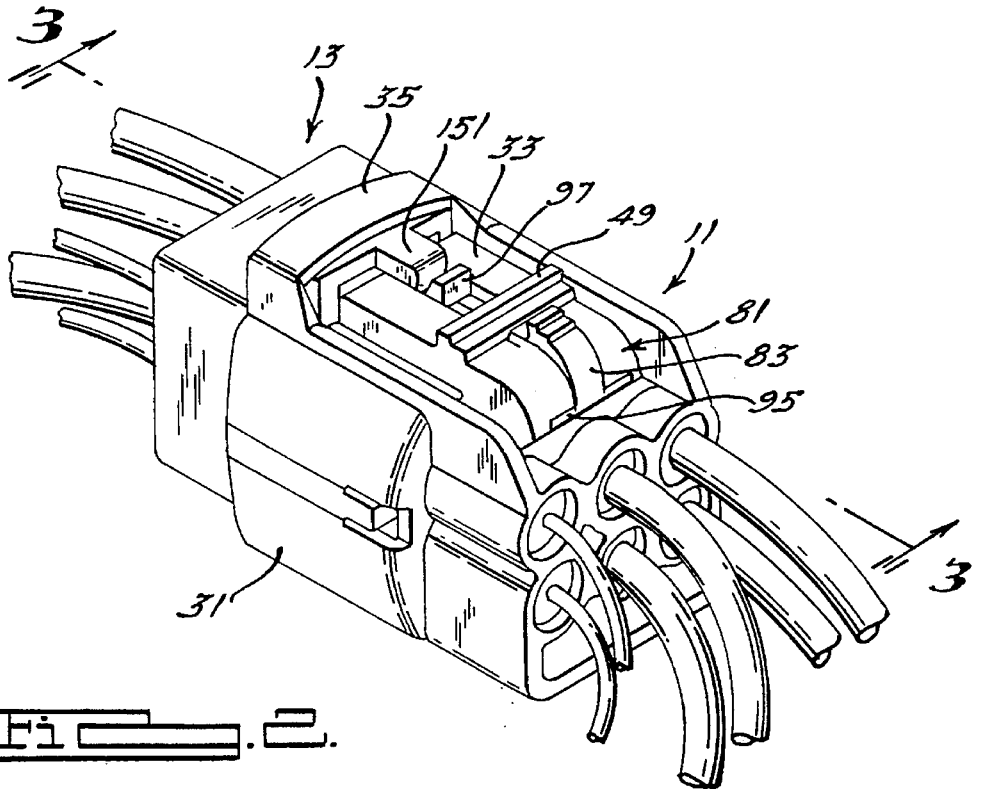
FIG. 2 is a perspective view showing the preferred embodiment of the present invention electrical connector assembly of FIG. 1 but in a fully installed position.

Referring to FIGS. 1 and 2, a female electrical connector 11 is mateable with a male electrical connector 13. Both electrical connectors 11 and 13 have internal terminal retention structures for respectively retaining female (not shown) and male electrical terminals 15. Female electrical terminals are of the general type disclosed within U.S. Pat. No. 4,717,359 entitled "Arrangement for Securing Electrical Terminal in Terminal Holder" which issued to Rahrig et al. on Jan. 5, 1988, the disclosure of which is incorporated by reference herewithin. Each electrical terminal has an electrically conductive discrete wire 17 attached thereto and extending from a backside of each electrical connector 11 and 13. Electrical terminals 11 and 13 are preferably made from an engineering grade polymeric resin such as VALOX® which can be purchased from GE Plastics Co.

Female electrical connector 11 includes a body 31, a locking arm 33 and a collar 35. A slot 41 is located between a distal end 43 of locking arm 33 and body 31. Locking arm 33 is further defined by a distal end 45, a pair of longitudinally oriented extension members 47 and a bridge 49. Distal end 45 further has a chamfered surface 51 and a rearwardly facing locking formation or surface 53. A void 55 is bordered by locking surface 53, bridge 49 and extension members 47. Bridge 49 and locking surface 53 are both transversely oriented members. Alternatively, locking arm 33 may be constructed from a single longitudinally elongated member with a transversely oriented undercut, slot, projection or the like. Also, slot 41 may have a number of differing shapes, configurations and locations.

A connector position assurance device 81 has a base 83, a median section 85 and a finger 87 aligned with one another in a longitudinal manner. Base 83 is further defined by a section 89 bulged upward from a nominal upper surface 91 of median section 85 and a pair of steps 93 upwardly projecting from bulged section 89. A pair of wings 95 perpendicularly extend in a transverse manner from a lower section of base 83. A fin 97 upwardly projects from upper surface 91 of median section 85. Fin 97 is further defined by an angled forward face 99, an upper surface 101 and a substantially straight rearward face 103. Finger 87 has a projecting member 111 closest to a leading edge 113. Finger 87 further has an abutting surface 115. A constricted or thinned cross sectional section 117 is located where finger 87 and median section 85 are joined. Thinned section 117 encourages flexure of finger 87 thereat. Connector position assurance device 81 is preferably injection molded from VALOX®.

Figure 3:
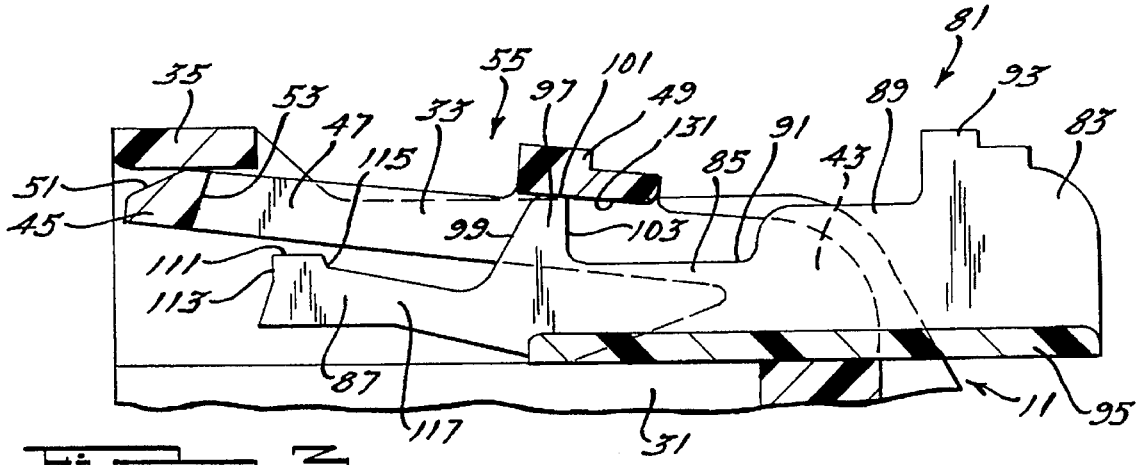
FIGS. 3–6 are sectional views, taken along line 3—3 of FIG. 2, showing the sequential steps employed to mate and install a pair of electrical connectors and a connector position assurance device of the preferred embodiment electrical connector assembly of the present invention.
Figure 4:
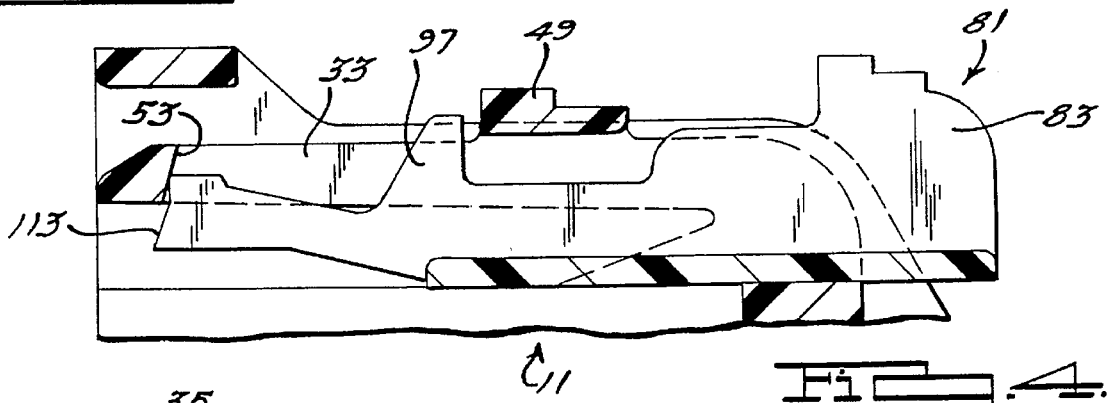

The installation employed with the present invention electrical connector assembly is shown in FIGS. 3 through 6. As is shown in FIG. 3, connector position assurance device 81 is first installed into female electrical connector 11 by sliding wings 95 longitudinally within slot 41 (see FIG. 1). During movement from an uninstalled (see FIG. 1) to an intermediate position, upper surface 101 of fin 97 concurrently flexes a lower surface 131 of bridge 49 away from body 31. This allows connector position assurance device 81 to move to the intermediate position of FIG. 4. In the intermediate position of FIG. 4, fin 97 of connector position assurance device is prevented from being inadvertently disengaged from female electrical connector 11 due to rearward face 103 abutting against a forward edge of bridge 49. Similarly, leading edge 113 of connector position assurance device 81 is prevented from being inserted too far by abutting against locking surface 53 of locking arm 33. A portion of base 83 projects rearwardly beyond a rear end of female electrical connector 11. FIG. 4 also illustrates locking arm 33 and connector position assurance device 81 in their nominal free states.

Figure 5:
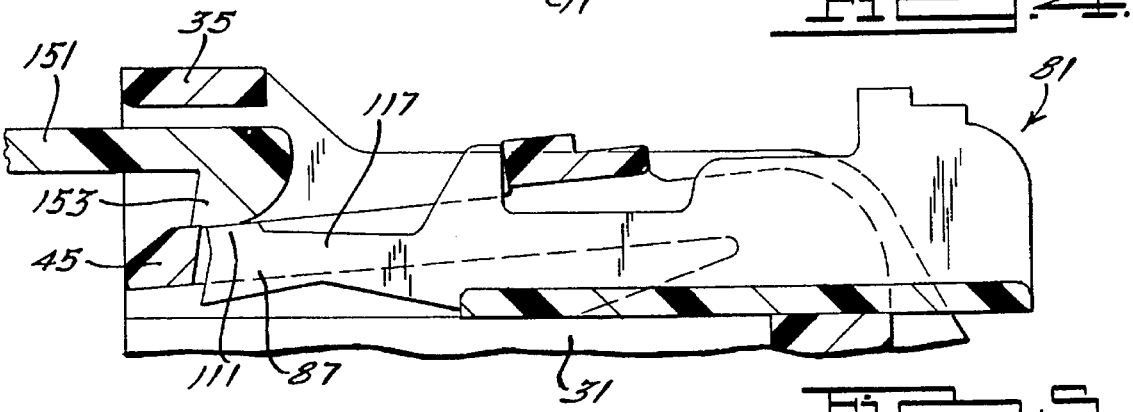

FIG. 5 shows a latching arm 151 of male electrical connector 13 (see FIG. 1) partially inserted between collar 35 along one side, and distal end 45 of locking arm 33 and projecting member 111 of connector position assurance device 81 at the other side. In this position, a downwardly extending barb 153 serves to depress distal end 45 and finger 87 downward toward body 31. Finger 87 predominantly flexes about thinned section 117 but may also flex along the entire longitudinal length thereof.

Figure 6:
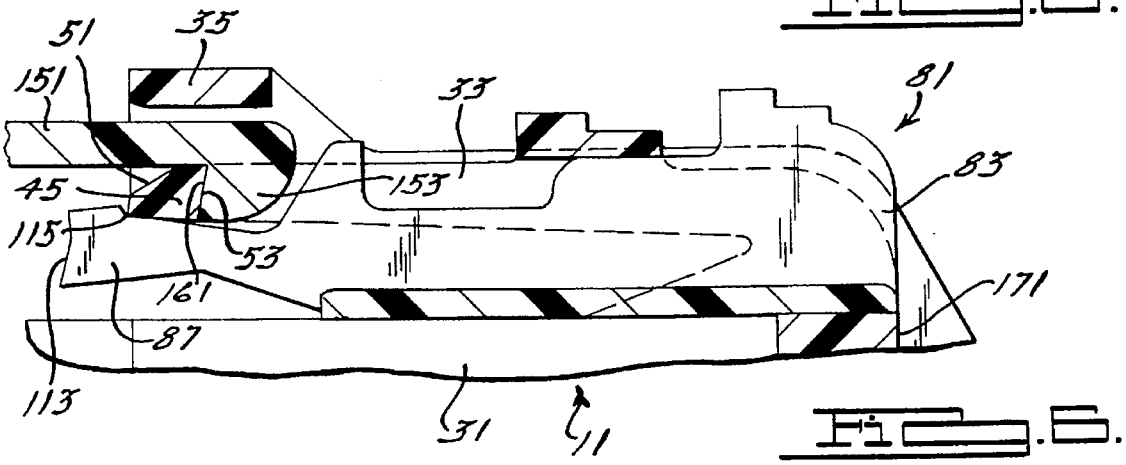

A fully installed position of latching arm 151 and connector position assurance device 81 is best shown in FIGS. 6 and 2. In this position, barb 153 has longitudinally traveled past distal end 45 of locking arm 33 such that distal end 45 upwardly flexes away from body 31. Subsequently, latching formation or surface 1 61 of barb 153 interlockably engages locking surface 53 of locking arm 33. An installer then longitudinally pushes connector position assurance device 81 to its fully inserted position, as shown, such that finger 87 upwardly flexes and abutting surface 115 abuts against a forwardmost portion of distal end 45.

When the installer pushes connector position assurance device 81 from the position of FIG. 5 to that of FIG. 6, leading edge 113 further aids in forwardly flexing distal end 45 of locking arm 33 so as to engage locking surface 53 with latching formation 161. Furthermore, the preferred thickness of finger 87 when in its fully inserted position prevents barb 153 from inadvertently passing back through and between distal end 45 and collar 35. Moreover, it is significant that connector position assurance device 81 visually signals full engagement and assertion between the mating electrical connectors when a rearmost edge of base 83 is generally flush with an end wall 171 of female electrical connector 11.

Preferably, an operator can disassemble connector position assurance device 81 by pushing rearwardly on step 93 (see FIG. 3). This allows angled abutting surface to cam below and past distal end 45. The electrical connectors can alternately be disassembled by an operator first engaging a flat screwdriver blade with a lower angled portion of leading edge 113 of connector position assurance device 81 thereby allowing longitudinal sliding disengagement thereof. Next, an operator inserts the Screwdriver blade along chamfer 51 (see FIG. 6) so as to depress locking arm 33 and longitudinally remove latching arm 151.

While the preferred embodiment of this electrical connector assembly employing a connector position assurance device has been disclosed, it will be appreciated that various modifications may be made without departing from the present invention. For example, the locking arm and connector position assurance device can be positioned on the male electrical connector. They can also be used in conjunction with one or more electrical junction boxes or other electrical devices that require interlocking attachment. The specific configuration of the electrical terminals can also be varied as is known to one skilled in the art. It is also envisioned that a collar and slot may not be required to perform various aspects of the present invention. Moreover, the connector position assurance device can have many other shapes and configurations as long as the various novel functions are achieved. Furthermore, the use of terms such as finger, medial section, base, collar, barb and the like are not intended to imply that these segments could not be combined or otherwise defined. Additionally, the present invention can also encompass inversion of the connector position assurance device and/or the barb and locking arms in relation to the electrical connector body. Various materials have been disclosed in an exemplary fashion, however, a variety of other materials may of course be employed. It is intended by the following claims to cover these and any other departures from the disclosed embodiment which fall within the true spirit of this invention.

The invention claimed is:

1. An electrical connector assembly comprising:

a first electrical connector having a locking arm defined by a proximal end joined to a body of said first electrical connector, said locking arm further defined by a distal end flexibly projecting in a longitudinal manner from said body, a substantially transversely oriented locking surface disposed upon said distal end of said locking arm;

a connector position assurance device including a base, a finger and a median segment therebetween, a fin upwardly projecting from said median segment;

a thinned section of said connector position assurance device being disposed substantially between said finger and said median segment, said thinned section allowing for additional flexure of said connector position assurance device thereat;

said fin preventing said connector position assurance device from becoming inadvertently disengaged from said first electrical connector by being abuttable against a transversely oriented disengagement portion of said first electrical connector; and a second electrical connector mating with said first electrical connector, a latching arm of said second electrical connector having a barb projecting from a distal end thereof, said barb flexing said distal end of said locking arm of said first electrical connector and said finger of said connector position assurance device upon insertion therepast.

2. The electrical connector assembly of claim 1 wherein said transversely oriented disengagement portion of said first electrical connector is disposed on said locking arm.

3. The electrical connector assembly of claim 2 wherein said at least one transversely oriented disengagement portion of said locking arm includes a transversely oriented bridge longitudinally disposed between said distal and proximal ends of said locking arm.

4. The electrical connector assembly of claim 3 wherein said locking arm further includes a pair of longitudinally oriented extension members transversely joined by said distal end and said bridge, a void being disposed between said transversely oriented locking formation and a forward edge of said bridge, said fin of said connector position assurance device disposed within said void when in its intermediate position.

5. The electrical connector assembly of claim 4 further comprising a top surface of said fin upwardly flexes said locking arm through contact with a lower surface of said bridge during movement of said connector position assurance device from an uninstalled position to said intermediate position.

6. The electrical connector assembly of claim 1 wherein said distal end of said locking arm of said first electrical connector flexes back toward a nominal position when said barb of said latching arm of said second electrical connector is fully inserted therepast whereby said locking surface of said locking arm abuts against a trailing surface of said barb.

7. The electrical connector assembly of claim 6 wherein said finger of said connector position assurance device is inserted to a fully installed position when said locking surface of said locking arm and said trailing surface of said barb are fully engaged.

8. The electrical connector assembly of claim 7 further comprising an upstanding structure disposed on said finger of said connector position assurance device abuts against a forwardmost portion of said distal end of said locking arm when said locking formation of said locking arm and said trailing surface of said barb are fully engaged, said connector position assurance device preventing inadvertent disengagement therebetween.

9. The electrical connector assembly of claim 1 wherein said connector position assurance device includes a pair of transversely oriented wings extending from said base for engagement with a transversely disposed slot between a portion of said locking arm proximate with said proximal end and said body of said first electrical connector, said pair of wings longitudinally slidable along said slot.

10. The electrical connector assembly of claim 9 wherein said base bulges upward from said median segment of said connector position assurance device opposite from said pair of wings and has at least one step further projecting upward therefrom.

11. An electrical connector assembly comprising:

a first electrical connector having a locking arm defined by a proximal end joined to a body of said first electrical connector, said locking arm further defined by a distal end flexibly projecting in a longitudinal manner from said body, a substantially transversely oriented locking surface disposed upon said distal end of said locking arm;

a connector position assurance device including a base, a finger and a median segment therebetween, a fin upwardly projecting from said median segment;

said fin preventing said connector position assurance device from becoming inadvertently disengaged from said first electrical connector by being abuttable against a transversely oriented disengagement portion of said first electrical connector;

said transversely oriented disengagement portion of said first electrical connector being disposed on said locking arm;

said at least one transversely oriented disengagement portion of said locking arm including a transversely oriented bridge longitudinally disposed between said distal and proximal ends of said locking arm; and said base of said connector position assurance device abutting against a lower surface of said bridge of said locking arm when said connector position assurance device is in a fully installed position thereby preventing flexing of said locking arm closest to said proximal end.

12. An electrical connector assembly comprising:

a first electrical connector having a locking arm defined by a proximal end joined to a body of said first electrical connector, said locking arm further defined by a distal end flexibly projecting in a longitudinal manner therefrom, a substantially transversely oriented locking surface disposed upon said distal end of said locking arm;

a connector position assurance device including a base, a finger and a median segment therebetween;

said first electrical connector also including a collar having a transversely oriented section longitudinally positioned near said distal end of said locking arm with said collar displaced farther away from said body of said first electrical connector than said distal end of said locking arm;

a second electrical connector mating with said first electrical connector, said second electrical connector having a latching arm with a latching formation extending substantially perpendicular therefrom, said latching arm inserted between said distal end of said locking arm and said transverse section of said collar such that said latching formation of said second electrical connector securely engages said locking surface of said first electrical connector; and said finger of said connector position assurance device fully insertable to a position between said distal end of said locking arm and said body of said first electrical connector after engagement of said latching portion and said locking surface such that the thickness of said finger prevents said latching portion of said second electrical connector from disengaging said locking surface of said first electrical connector, said latching portion prevented from passing back between said distal end of said locking arm and said collar without longitudinal disengagement of said connector position assurance device;

a transversely oriented disengagement portion of said first electrical connector being disposed on said locking arm, said transversely oriented disengagement portion of said locking arm including a transversely oriented bridge longitudinally disposed between said distal and proximal ends of said locking arm; and said base of said connector position assurance device abutting against a lower surface of said bridge of said locking arm when said connector position assurance device is in a fully installed position thereby substantially preventing flexing of said locking arm closest to said proximal end.

13. The electrical connector assembly of claim 12 wherein said connector position assurance device includes a pair of transversely oriented wings extending from said base for engagement with a transversely disposed slot between a portion of said locking arm proximate with said proximal end thereof and said body of said first electrical connector, said pair of wings longitudinally slidable along said slot.

14. The electrical connector assembly of claim 12 further comprising an upstanding structure disposed on said finger of said connector position assurance device abutting against a forwardmost portion of said distal end of said locking arm when said locking surface of said locking arm and a trailing surface of said latching formation are fully engaged, said connector position assurance device preventing inadvertent disengagement therebetween.

15. An electrical connector assembly comprising:

a first electrical connector having a locking arm defined by a proximal end joined to a body of said first electrical connector, said locking arm further defined by a distal end flexibly projecting in a longitudinal manner therefrom, a substantially transversely oriented locking surface disposed upon said distal end of said locking arm;

a connector position assurance device including a base, a finger and a median segment therebetween;

said first electrical connector also including a collar having a transversely oriented section longitudinally positioned near said distal end of said locking arm with said collar displaced farther away from said body of said first electrical connector than said distal end of said locking arm;

a second electrical connector mating with said first electrical connector, said second electrical connector having a latching arm with a latching formation extending substantially perpendicular therefrom, said latching arm inserted between said distal end of said locking arm and said transverse section of said collar such that said latching formation of said second electrical connector securely engages said locking surface of said first electrical connector;

said finger of said connector position assurance device fully insertable to a position between said distal end of said locking arm and said body of said first electrical connector after engagement of said latching portion and said locking surface such that the thickness of said finger prevents said latching portion of said second electrical connector from disengaging said locking surface of said first electrical connector, said latching portion prevented from passing back between said distal end of said locking arm and said collar without longitudinal disengagement of said connector position assurance device; and a thinned section of said connector position assurance device being disposed substantially between said finger and said median segment, said thinned section allowing for additional flexure of said connector position assurance device thereat.

16. The electrical connector assembly of claim 15 further comprising a transversely oriented disengagement portion of said first electrical connector disposed on said locking arm.

17. The electrical connector assembly of claim 16 wherein said transversely oriented disengagement portion of said locking arm includes a transversely oriented bridge longitudinally disposed between said distal and proximal ends of said locking arm.

18. The electrical connector assembly of claim 17 wherein said locking arm further includes a pair of longitudinally oriented extension members transversely joined by said distal end and said bridge, a void being disposed between said transversely oriented locking surface and a forward edge of said bridge, a fin of said connector position assurance device disposed within said void when in its intermediate position.

19. The electrical connector assembly of claim 18 further comprising a top surface of said fin upwardly flexing said locking arm through contact with a lower surface of said bridge during movement of said connector position assurance device from an uninstalled position to said intermediate position.

20. The electrical connector assembly of claim 17 wherein said base of said connector position assurance device abuts against a lower surface of said bridge of said locking arm when said connector position assurance device is in a fully installed position thereby preventing flexing of said locking arm closest to said proximal end.

21. An electrical connector assembly comprising:

a first electrical connector having a locking arm defined by a proximal end joined to a body of said first electrical connector, said locking arm further defined by a distal end flexibly projecting in a longitudinal manner therefrom, a substantially transversely oriented locking surface disposed upon said distal end of said locking arm;

a connector position assurance device including a base, a finger and a median segment therebetween;

said first electrical connector also including a collar having a transversely oriented section longitudinally positioned near said distal end of said locking arm with said collar displaced farther away from said body of said first electrical connector than said distal end of said locking arm;

a second electrical connector mating with said first electrical connector, said second electrical connector having a latching arm with a latching formation extending substantially perpendicular therefrom, said latching arm inserted between said distal end of said locking arm and said transverse section of said collar such that said latching formation of said second electrical connector securely engages said locking surface of said first electrical connector;

said finger of said connector position assurance device fully insertable to a position between said distal end of said locking arm and said body of said first electrical connector after engagement of said latching portion and said locking surface such that the thickness of said finger prevents said latching portion of said second electrical connector from disengaging said locking surface of said first electrical connector, said latching portion prevented from passing back between said distal end of said locking arm and said collar without longitudinal disengagement of said connector position assurance device;

said connector position assurance device including a pair of transversely oriented wings extending from said base for engagement with a transversely disposed slot between a portion of said locking arm proximate with being said proximal end thereof and said body of said first electrical connector, said pair of wings longitudinally slidable along said slot; and said base bulging upward from said median segment of said connector position assurance device opposite from said pair of wings and having at least one step further projecting upward from said base.

22. An electrical connector assembly comprising:

a first electrical connector having a locking arm defined by a proximal end joined to a body of said first electrical connector, said locking arm further defined by a distal end flexibly projecting in a longitudinal manner therefrom, a substantially transversely oriented locking surface disposed upon said distal end of said locking arm, said first electrical connector further including a collar positioned above said distal end of said locking arm;

a connector position assurance device including a base, a median segment and a finger;

said base of said connector position assurance device being larger in cross sectional shape than said median segment adjacent thereto, said base contacting against a transversely oriented portion of said locking arm when said connector position assurance device is in a fully installed position so as to deter flexing of said locking arm toward said body of said first electrical connector; and a thinned section of said connector position assurance device being disposed substantially between said finger and said median segment, said thinned section allowing for additional flexure of said connector position assurance device.

23. The electrical connector assembly of claim 22 further comprising a transversely oriented bridge longitudinally disposed between said distal and proximal ends of said locking arm.

24. The electrical connector assembly of claim 23 wherein said locking arm further includes a pair of longitudinally oriented extension members transversely joined by said distal end and said bridge, a void being disposed between said transversely oriented locking surface and a forward edge of said bridge, a fin of said connector position assurance device disposed within said void when in its intermediate position.

25. The electrical connector assembly of claim 24 further comprising a top surface of said fin upwardly flexing said locking arm through contact with a lower surface of said bridge during movement of said connector position assurance device from an uninstalled position to said intermediate position.

26. The electrical connector assembly of claim 22 wherein said connector position assurance device includes a pair of transversely oriented wings extending from said base for engagement with a transversely disposed slot between a portion of said locking arm proximate with said proximal end thereof and said body of said first electrical connector, said pair of wings longitudinally slidable along said slot.

27. The electrical connector assembly of claim 26 wherein said base bulges upward from said median segment of said connector position assurance device opposite from said pair of wings and has at least one step further projecting upward therefrom.

28. An electrical connector assembly comprising:

a first electrical connector having a locking arm defined by a proximal end joined to a body of said first electrical connector, said locking arm further defined by a distal end flexibly projecting in a longitudinal manner therefrom, a substantially transversely oriented locking surface disposed upon said distal end of said locking arm;

a connector position assurance device including a base, a median segment and a finger;

said base of said connector position assurance device being larger in cross sectional shape than said median segment adjacent thereto, said base contacting against a transversely oriented portion of said locking arm when said connector position assurance device is in a fully installed position so as to deter flexing of said locking arm toward said body of said first electrical connector;

a second electrical connector mating with said first electrical connector, a latching arm of said second electrical connector having a barb projecting from a distal end thereof, said barb flexing said distal end of said locking arm of said first electrical connector and said finger of said connector position assurance device upon insertion therepast;

said distal end of said locking arm of said first electrical connector flexing back toward a nominal position when said barb of said latching arm of said second electrical connector is fully inserted therepast whereby said locking surface of said locking arm abuts against a trailing surface of said barb;

said finger of said connector position assurance device being inserted to a fully installed position when said locking surface of said locking arm and said trailing surface of said barb are fully engaged; and an upstanding structure disposed on said finger of said connector position assurance device abuts against a forwardmost portion of said distal end of said locking arm when said locking surface of said locking arm and said trailing surface of said barb are fully engaged, said connector position assurance device preventing inadvertent disengagement therebetween.

* * * * *